US007386261B2

(12) United States Patent
Noguchi et al.

(10) Patent No.: US 7,386,261 B2
(45) Date of Patent: Jun. 10, 2008

(54) IMAGE FORMING APPARATUS HAVING MOVABLE DEVELOPING DEVICES AND DEVELOPER REPLENISHMENT DEVICE

(75) Inventors: Akihiro Noguchi, Toride (JP); Fumitake Hirobe, Ushiku (JP); Akinori Tanaka, Kashiwa (JP); Tadayoshi Nishihama, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 308 days.

(21) Appl. No.: 11/242,939

(22) Filed: Oct. 5, 2005

(65) Prior Publication Data

US 2006/0088341 A1 Apr. 27, 2006

(30) Foreign Application Priority Data

Oct. 19, 2004 (JP) ..... 2004-304969

(51) Int. Cl.
*G03G 15/08* (2006.01)

(52) U.S. Cl. ..... 399/258; 399/227

(58) Field of Classification Search ..... 399/54, 399/223, 224, 226, 227, 254, 255, 256, 258
See application file for complete search history.

(56) References Cited

U.S. PATENT DOCUMENTS 5,110,705 A * 5/1992 Hosoya et al. ..... 430/123.58
5,270,138 A * 12/1993 Kaneko et al. ..... 430/47.1
5,669,036 A * 9/1997 Hotta et al. ..... 399/53
5,819,132 A 10/1998 Hirobe ..... 394/49
5,918,092 A 6/1999 Hama ..... 399/227
6,577,834 B2 * 6/2003 Suzuki ..... 399/254
6,658,227 B2 * 12/2003 Oyama et al. ..... 399/267
6,973,281 B2 12/2005 Hirobe et al. ..... 399/269
7,054,581 B2 * 5/2006 Yoshikawa et al. ..... 399/227
7,099,609 B2 8/2006 Hirobe et al. ..... 399/269
2006/0222415 A1 10/2006 Hirobe ..... 399/265

FOREIGN PATENT DOCUMENTS

JP 10020584 * 1/1998
JP 10-149012 6/1998

* cited by examiner

*Primary Examiner*—Robert Beatty
(74) *Attorney, Agent, or Firm*—Fitzpatrick, Cella, Harper & Scinto

(57) ABSTRACT

The image forming apparatus includes a developing device, a movable member, a replenishment device, a developer replenishment path, and a conveyance screw so arranged within the developer replenishment path as not to come into contact with the internal wall of the developer replenishment path, wherein X (g) representing the quantity of the developer for replenishment present in the clearance section between the developer replenishment path and the conveyance screw, Y (g) representing the quantity of the developer in the developing device, Q(μC/mg) representing the absolute value of the electric charge per unit weight of the toner in the developing device, and A(μC/mg) representing the absolute value of the electric charge per unit weight of the toner relative to a 1% variation in the toner density satisfy the condition of a relationship of $X \leqq (Y \times Q)/(500 \times A)$.

4 Claims, 5 Drawing Sheets

IMAGE FORMING APPARATUS HAVING MOVABLE DEVELOPING DEVICES AND DEVELOPER REPLENISHMENT DEVICE

BACKGROUND OF THE INVENTION

1. Field of the Invention

The present invention relates to image forming apparatuses such as copying machines, facsimile machines and printers which form an electrostatic latent image on an image bearing member by an electrophotographic or electrostatic recording method or otherwise, and turns this electrostatic latent image into a visible image (toner image) with a developer accommodated in a developing device.

2. Related Background Art

In a conventional color image forming apparatus of an electrophotographic type, for example, toner images each of a different color, namely yellow, cyan, magenta and black, are formed on an image bearing member such as a photosensitive member (photosensitive drum), and these toner images of different colors are transferred and superposed on a recording sheet to have a full color image formed on the recording sheet in turn. This is known as a multi-layer transfer process.

Since it is required in this multi-layer transfer process to form toner images of different colors on the photosensitive drum in turn, one at a time of a plurality of developing devices, each containing a toner of one color or another, is selectively set in a developing position opposite the photosensitive drum, and all other developing devices have to be set in waiting positions away from the image bearing member.

For this reason, this conventional color image forming apparatus uses a so-called rotary developing unit, in which the plurality of developing devices are arranged at equal intervals on a movable member. The movable member has a circumferential surface of a cylindrical rotating body and is rotatable(hereinafter referred to as developing rotary). The movable member selectively sets one or another of the four-color developing devices in the developing position. By the movable member, any desired developing device is set in the developing position by the rotation of the developing rotary, while the other developing devices are kept away from positions close to the photosensitive drum.

Incidentally, a two-component developing system which uses a mixture of a non-magnetic toner and a magnetic carrier as the developer is extensively used in image forming apparatuses which form color images in particular among electrophotographic image forming apparatuses. The two-component developing system has advantages in the stability of image quality and the durability of the apparatus among other respects over other developing systems which have been proposed so far.

In the developing using two-component developers, out of the toner and the carrier contained in each developing device, only the toner is consumed by the development of electrostatic latent images, and accordingly the developing device held by the developing rotary has to be replenished with a new supply of toner in turn. Therefore, in order to maintain the developed density of electrostatic latent images at the desired level all the time, the quantity of the toner with which each developing device is replenished with should be kept under strict control.

There is another problem. Every time the developing rotary is turned to change the developing device set in the developing position, a developing device, a toner replenishment container and a toner replenishment passage have to turn around the rotation axis of the developing rotary and, even in a state in which a conveyance screw disposed in the toner replenishment passage is at halt, the toner moves along the spiral blades of the conveyance screw and automatically conveyed within the toner replenishment passage, inviting an excess or shortage of the toner for replenishment.

As a proposed solution to these problems, as shown in FIG. 5 appended to the present application, Japanese Patent Application Laid-Open H10-149012 discloses a rotary developing unit in which a developing rotary 100 is mounted with a developing device 101, and toner conveyance means 104 for conveying the toner from a toner replenishment container 102 to the developing device 101 within a toner replenishment passage 103 is provided. When the toner conveyance means 104 is stopped and the developing rotary 100 is turned, the toner within the toner replenishment passage 103 is conveyed from a developing device discharge outlet 105 to a toner replenishment container receptacle 106, and the toner replenishment quantity is controlled according to the rotational speed of the developing rotary 100.

However, when the developing device is sent in the developing position opposite the photosensitive drum, the vibration at the time of stopping causes the toner remaining in the toner replenishment passage to slip sideways, and the toner gradually moves toward the developing device to be eventually fed to,the developing device.

When this phenomenon occurs, no large quantity of toner moves into the developing device in a single turn of a developing rotary 18 around a rotation axis 18*a*. However, in an image forming apparatus which has developing devices for yellow, cyan, magenta, black, light magenta and light cyan, for instance, and can operate in either a four-color mode or a six-color mode, the rotation of the developing rotary around its rotation axis accelerates the movement of toners remaining in the toner replenishment passage into the developing devices for light magenta and light cyan, neither used in the four-color mode. Therefore, unintended feeding of toners to the developing devices for light magenta and light cyan is especially accelerated, resulting in an increased density of these toners and a corresponding variation in development performance.

SUMMARY OF THE INVENTION

An object of the present invention, therefore, is to provide an image forming apparatus in which the movement of a movable member supporting a developing device prevents, even if unintended replenishment is done, the density from varying seriously enough to invite a deterioration in the image grade.

In order to achieve the objected stated above, an image forming apparatus according to the invention comprises a developing device which develops an electrostatic latent image with a developer containing a toner and a carrier on an image bearing member; a movable member which supports the developing device and is movable between a developing position at which said movable member is opposed to said image bearing member and a non-developing position at which said movable member is not opposed said image bearing member; a replenishment device which feeds a developer for replenishment to the developing device; a developer replenishment path which is supported by the movable member and is intended to allow the developer for replenishment to be fed from the replenishment device to the developing device; and a conveyance screw so arranged within the developer replenishment path as not to come into contact with the internal wall of the developer replenishment path, wherein X (g) representing the quantity of the developer for replenishment present in the clearance section between the developer replenishment path and the conveyance screw, Y (g) representing the quantity of the developer in the developing device, Q(μC/mg) representing the absolute value of the electric charge per unit weight of the toner in the developing device, and A(μC/mg) representing the absolute value of the electric charge per unit weight of the toner relative to a 1% variation in the toner density, X (g), Y (g), Q(μC/mg) and A(μC/mg) satisfy the relationship of $X \leqq (Y \times Q)/(500 \times A)$.

DETAILED DESCRIPTION OF THE EMBODIMENT

With reference to drawings, an image forming apparatus of the present invention will be explained in detail below. Incidentally, the statement of the dimensions, material, shape or relative position of any constituent part of the image forming apparatus is not intended to limit the scope of the invention unless otherwise stated specifically.

Embodiment 1

Figure 1:
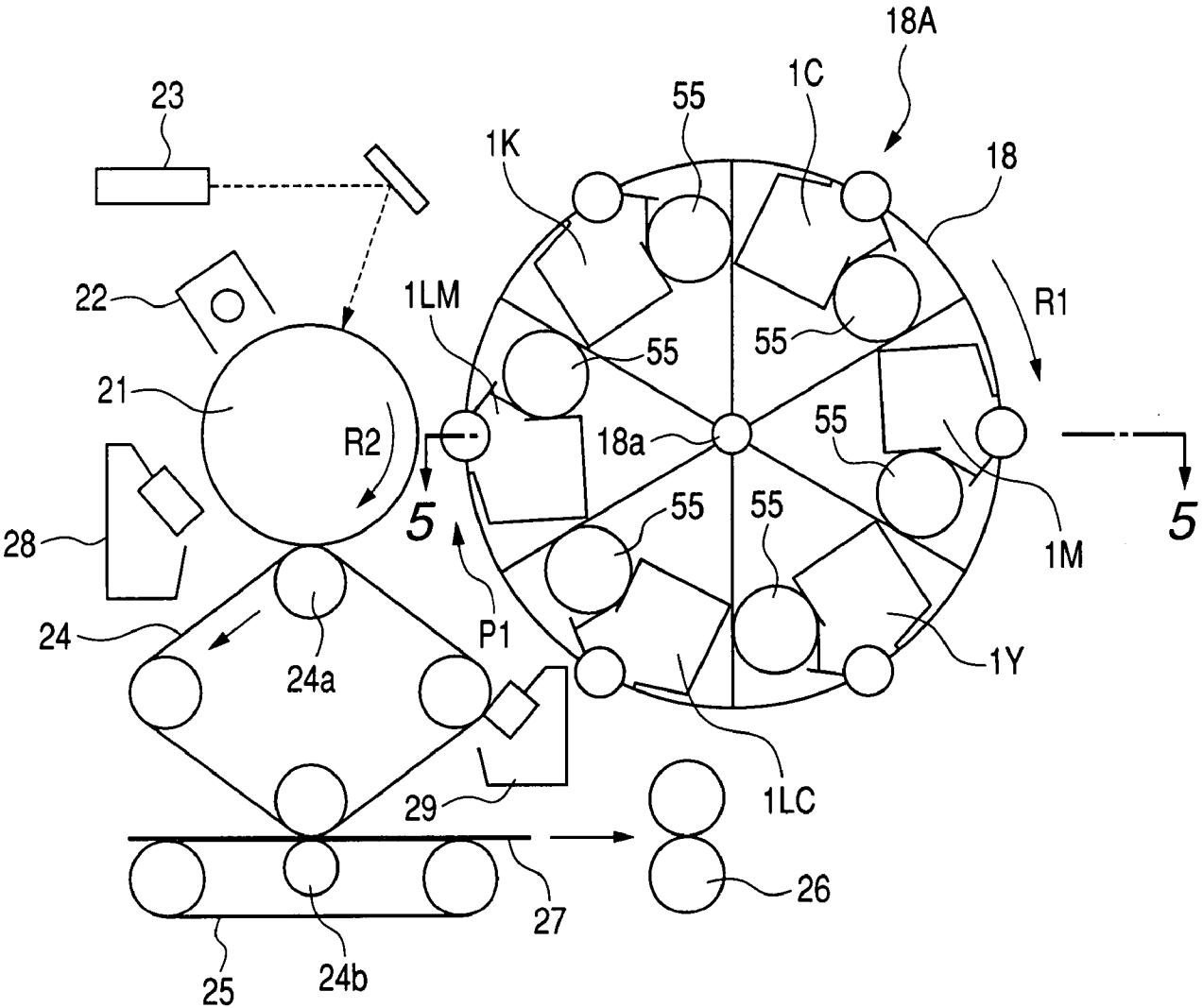
FIG. 1 shows a schematic configuration of an image forming apparatus according to the present invention.

FIG. 1 shows a schematic configuration of the image forming apparatus embodying the invention in one mode of implementation. In this embodiment, the image forming apparatus has a photosensitive drum which is a cylindrical photosensitive member as an image bearing member, and color images are formed on the photosensitive drum with a plurality of developing devices supported by a developing rotary which is a rotatable movable member.

Referring to FIG. 1, in the image forming apparatus of this embodiment, a rotary developing unit 18A is arranged opposite a photosensitive drum 21. The rotary unit 18A is provided with a developing rotary 18, which has a plurality of developing devices including in this particular embodiment a black developing device 1K, a yellow developing device 1Y, a magenta developing device 1M, a cyan developing device 1C, a light magenta developing device 1LM and a light cyan developing device 1LC. The rotation axis 18*a* of the developing rotary 18 can be freely turned by a motor not shown.

When a light magenta toner image is to be formed on the photosensitive drum 21, toner development is performed with the light magenta developing device 1LM in a developing position P1 close to the photosensitive drum 21. Similarly, when a light cyan toner image is to be formed, the developing rotary 18 is turned by 60° in the R1 direction to arrange the light cyan developing device 1LC in the developing position P1 and toner development is performed with it. Yellow, magenta, cyan and black toner images are also formed in the same manner.

Next will be described the overall operation of the image forming apparatus, which is the characteristic part of this embodiment.

In the following description, developing devices 1 is a generic term collectively referring to the black developing device 1K, the yellow developing device 1Y, the magenta developing device 1M, the cyan developing device 1C, the light magenta developing device 1LM and the light cyan developing device 1LC.

In this embodiment shown in FIG. 1, the photosensitive drum 21 is supposed to be rotatable in the R2 direction and charged by a primary charger 22, and an electrostatic latent image is formed on the charged photosensitive drum 21 by being exposed to light by an exposure device 23. This electrostatic latent image is developed by developing devices 1 containing desired toners into a visible image, namely a toner image. This toner image on the photosensitive drum 21 is transferred onto an intermediate transfer belt 24, serving as an intermediate transfer member, by a first transfer bias applied by a first transfer charger 24*a* serving as first transfer means.

When a full color image is to be formed, first a light magenta toner image is formed on the photosensitive drum 21 by the light magenta developing device 1LM arranged in the developing position P1, and the light magenta toner image is subjected to a primary transfer onto the intermediate transfer belt 24. Next, the developing rotary 18 is turned by 60° to arrange the light cyan developing device 1LC in the developing position P1 to form a light cyan toner image on the photosensitive drum 21, and the light cyan toner image is subjected to a primary transfer and superposed over the earlier transferred light magenta toner image on the intermediate transfer belt 24. This operation is performed by the yellow developing device 1Y, the magenta developing device 1M, the cyan developing device 1C and the black developing device 1K to form a full color image of color toners on the intermediate transfer belt 24 in turn.

After that, the images in different colors superposed on the intermediate transfer belt 24 are collectively subjected to a secondary transfer onto a recording paper sheet 27 on a transfer paper conveyance belt 25 by a second transfer bias applied by a second transfer charger 24*b* serving as second transfer means. The recording paper sheet 27 onto which the images have been transferred is peeled off the transfer paper conveyance belt 25, and subjected to pressure and heat by a fixing apparatus 26 to provide a permanent image.

The residual toner remaining in the photosensitive drum 21 after the primary transfer is removed by a first cleaner 28, and the residual toner remaining on the intermediate transfer belt 24 after the secondary transfer is removed by a second cleaner 29 to prepare for the next round of image formation.

Next will be described the two-component developer containing a toner and a carrier for use in this embodiment.

The toner comprises coloring resin particles containing a binding resin, coloring agent and, as required, other additives and coloring particles to which an external additive, such as fine powder of colloidal silica, is externally added. The toner further is a negatively chargeable polyester resin, whose preferable mean volume particle size is not less than 5 μm but not more than 8 μm. In this embodiment, it is 7.0 μm.

The suitable choice for the carrier includes, for instance, metals either oxidized or not oxidized on the surface, such as iron, nickel, cobalt, manganese, chromium and rare earths, their alloys and oxide ferrites, and there is no particular limitation regarding the method of manufacturing these magnetic particles. It is preferable for the carrier to be 20 to 50 μm, more preferably 30 to 40 μm, in mean volume particle size and not less than $10^7$ Ωm, more preferably $10^8$ Ωm, in resistivity. The carrier used in this embodiment is 40 μm in mean volume particle size, $5\times10^7$ Ωm in resistivity and 260 emu/cc in magnetization level.

The mean volume particle size of the toner for use in this embodiment was measured by the apparatuses and method described below.

The measurement apparatuses used were a TA-II type Coulter counter (a product of Coulter Electronics), an interface for outputting the mean distribution of the number of units and that of the volume (a product of Nikkaki) and a CX-I personal computer (a product of Canon). A 1% aqueous solution of NaCl prepared by using first class sodium chloride was used as the electrolytic aqueous solution.

The measurement method was as follows: A surface activating agent, preferably together with 0.1 ml of alkyl benzene sulfonate, was added as a dispersant to 100 to 150 ml of the electrolytic aqueous solution of the above-described composition, to which 0.5 to 50 mg of the measurement sample was added.

The electrolytic aqueous solution in which the sample was suspended was subjected to dispersion for about 1 to 3 minutes by an ultrasonic disperser, and the distribution of particles of 2 of 40 μm in size was determined with the TA-II type Coulter counter using an aperture of 100 μm to figure out the mean volume distribution, from which the mean volume particle size was obtained.

The resistivity of the carrier for use in this embodiment was measured by using a sandwich type cell of 4 cm in measurement electrode area at a space of 0.4 cm between the electrodes, with a voltage E (V/cm) being applied between the two electrodes under a weight of 1 kg brought upon one of the electrodes. The resistivity of the carrier was determined from the current that flowed through the circuit.

Figure 2:
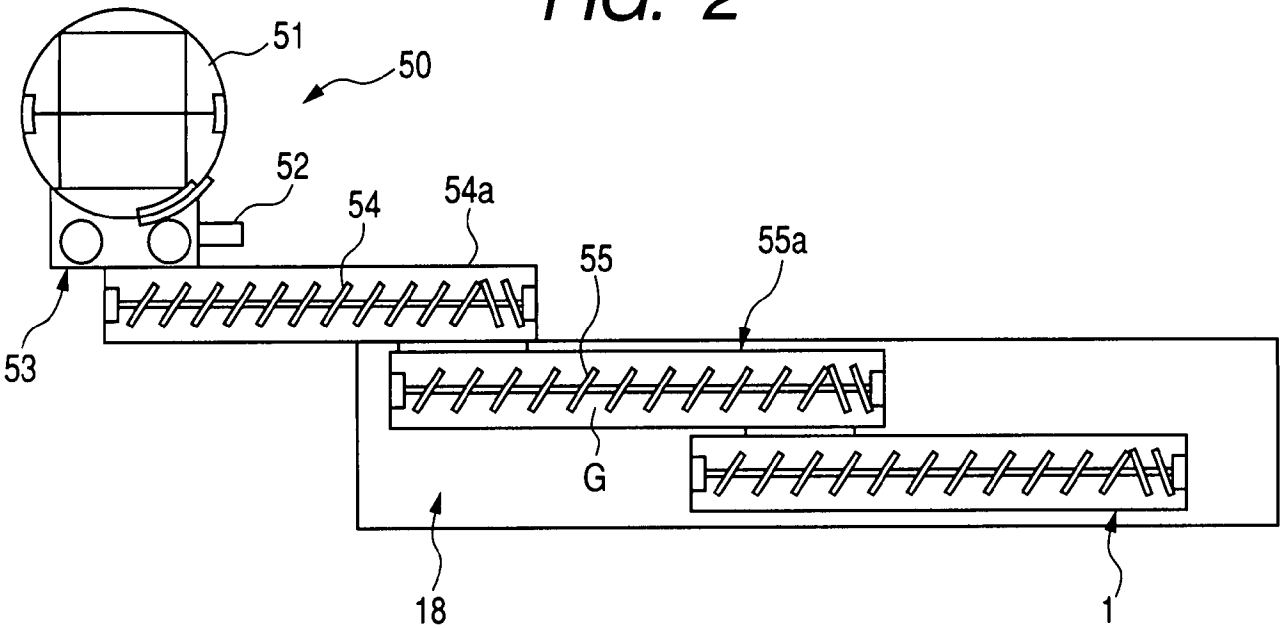
FIG. 2 shows a schematic configuration of one embodiment of a supply path from a toner replenishment section to developing devices according to the invention.

FIG. 2 shows a schematic configuration of a toner replenishment section and a supply path in the mage forming apparatus of this embodiment. In the embodiment shown in FIG. 2, a toner replenishment section 50 has a toner cartridge 51, filled with a toner which is the developer for replenishment, and a hopper 53. When a piezometer 52 disposed in the hopper 53 ceases to detect any toner, some additional toner is supplied from the cartridge 51.

The toner replenishment section 50 is provided with a toner conveyance path 54*a* and a toner conveyance screw (hereinafter referred to as hopper replenishment screw) 54, and the toner conveyance path 54*a* and the hopper replenishment screw 54 feed the toner supplied from the hopper 53 to each of developing devices 1 mounted on the developing rotary 18.

The hopper replenishment screw 54 performs replenishment to the developing devices 1 by turning a prescribed number of times under the control of an automatic toner replenishment device(automatic toner replenisher (ATR)). The toner conveyed from the hopper replenishment screw 54 is supplied to a toner conveyance path 55*a* disposed in the developing rotary 18 and a second toner conveyance screw 55 (hereinafter referred to as rotary replenishment screw).

The toner fed to the developing rotary 18 is wholly conveyed by the rotary replenishment screw 55 into the developing devices 1. The developing devices are replenished with the toners by the operation described so far.

Figure 3:
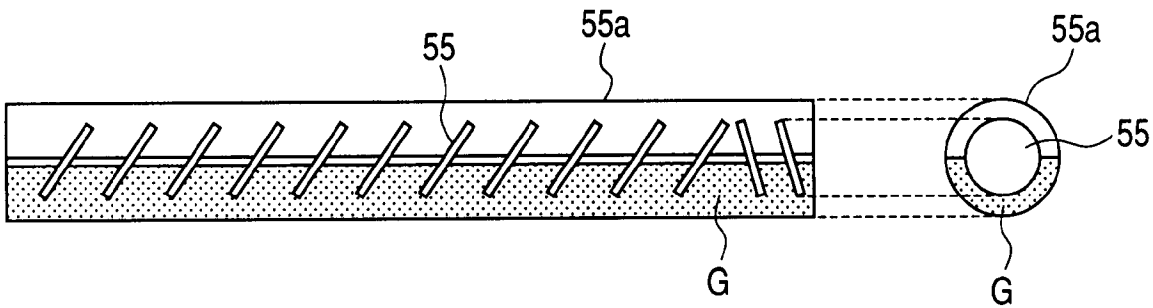
FIG. 3 shows the clearance section between the developer replenishment path and a rotary replenishment screw.

Although it was stated above that the toners were wholly conveyed by the rotary replenishment screw 55 into the developing devices 1, a clearance section G (see FIG. 3) of some size is provided between the rotary replenishment screw 55 and the inner diameter of the toner conveyance path 55*a* accommodating this screw 55 to prevent the toner from forming a coagulation, which would invite a faulty image. Therefore, more or less toner is present in this clearance section G.

The toner for replenishment in this clearance section G poses no problem as long as normal replenishment is performed. However, when the rotational action of the developing rotary 18 around the rotation axis 18*a* of the developing rotary 18 sets in, even if the spiral blades are so wound round the rotation axis as to have the toner for replenishment conveyed in a direction away from the developing devices 1, the vibration which is generated by the stopping action of the developing devices 1 causes the toner remaining in the clearance section G within the toner replenishment path 55*a* to slip sideways, with the possible consequence that the toner gradually moves toward and is fed to the developing devices 1. This could invite a variation in the toner density within the developing devices 1 and accordingly degrading of the image.

Further, only one round of the rotation of the developing rotary 18 around the rotation axis 18*a* of the developing rotary 18 would not cause a large quantity of the toner to move into the developing devices 1. However, where there are six developing devices 1 as in this embodiment and they can operate in either a four-color mode or a six-color mode, the light magenta and light cyan developing devices 1LM and 1LC which are not used in the four-color mode will only follow the rotation of the developing rotary 18 around the rotation axis 18*a* of the developing rotary 18 as long as the operation remains in the four-color mode, and eventually the toner remaining in the clearance section G will be wholly moved into the developing devices 1.

With these factors being taken into consideration, the volume of the developer remaining in the clearance section G between the rotary replenishment screw 55 and the inner diameter of the conveyance path 55*a* is determined according to the following conditions.

The tribo-electric charge variation rate R is $R=[A\times\{(X/Y)\times100\}]/Q$, where X (g) is the quantity of the toner (developer for replenishment) remaining in the clearance section between the developer conveyance path where the developer to replenish developing devices passes and the developer conveyance screw for conveying the developer toward the developing devices through this developer conveyance path, such as the clearance section G between the conveyance path 55*a* and the rotary replenishment screw 55 in this embodiment, Y (g) is the quantity of the developer in the developing devices 1, Q (pC/mg) is the absolute value of the charge of the toner in the developing devices 1 per unit weight, and A (pC/mg) is the absolute value of the charge of the toner when the toner density has varied by 1%.

Especially in this embodiment, the quantity of the toner remaining in the clearance section G between the conveyance path 55*a* and the rotary replenishment screw 55, namely the toner which may conceivably be moved to the developing devices 1 by the rotation of the developing rotary 18 around the rotation axis 18*a* of the developing rotary 18, is taken into consideration as the quantity X (g) of the toner remaining in the clearance section G between the developer conveyance path and the developer conveyance screw.

However, if the configuration of the toner replenishment section and the conveyance path is such that the quantity of the toner remaining in the clearance section between the conveyance path 54*a* of the hopper section 53 and the hopper replenishment screw 54, as well as the quantity of the toner remaining in the conveyance path from the cartridge 51 to the hopper section 53, also affects the developing devices 1, these developer conveyance path and conveyance screw should also be taken into account as part of the aforementioned developer conveyance path and developer conveyance screw to be considered. Where they are taken into account, the quantity of the toner remaining in the clearance section between these developer conveyance path and developer conveyance screw is added to X(g) above.

Figure 4:
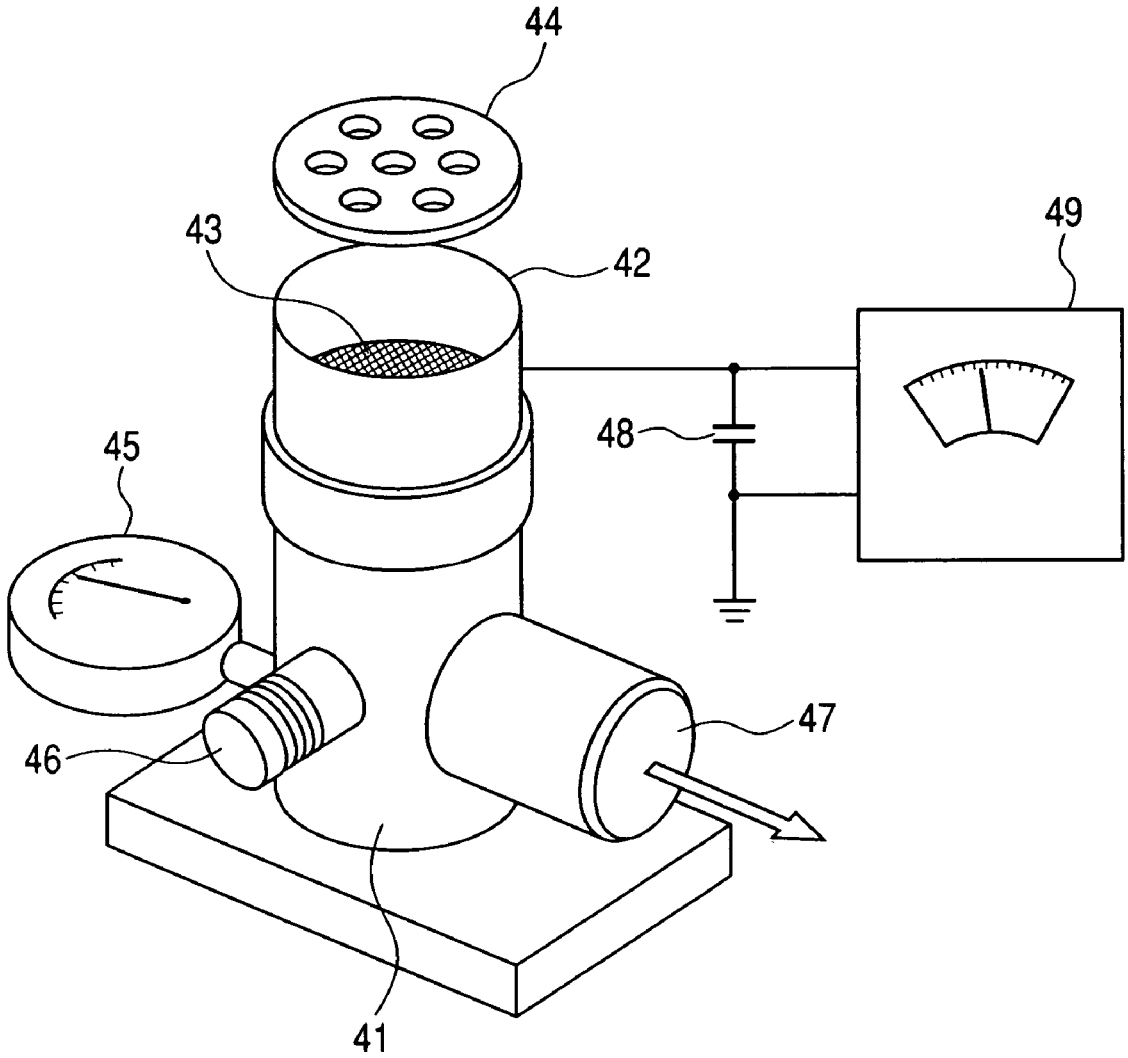
FIG. 4 is a perspective view of a measurement apparatus used for measuring the level of the tribo-electric charge of the toner constituting one ingredient of the two-component developer.

FIG. 4 shows a measurement apparatus used for measuring the level of the electric charge (tribo-electric charge) of the toner.

First, the toner whose tribo-electric charge is to be measured is combined with a carrier into a two-component developer form. The developer is put into a polyethylene bottle of 50 to 100 ml in capacity, and shaken by hand for about 10 to 40 seconds. Then, about 0.5 to 1.5 of this developer is put into a metallic measurement container 42 whose bottom is an electroconductive screen 43 of 635 meshes, and the container 42 is covered with a metallic lid 44. The gross weight of the measurement container 42 measured in this state is represented by W1 (g).

Next, the measurement container 42 is installed on an aspirator 41 (the aspirator 41 should be insulative at least in the part in contact with the measurement container 42), aspiration is performed through an aspiration inlet 47 under control with an air flow control valve 46 until the pressure reading of a vacuum gauge 45 reaches 250 mmAq. In this state, aspiration is further performed preferably for two minutes to remove the toner by aspiration. The potential indicated then on a potentiometer 49 connected to the measurement container 42 is read, and this is represented by V1 (V). The gross weight of the measurement container 42 measured after the aspiration is represented by W2 (g). The capacitance of a capacitor 48 connected to the measurement container 42 in parallel with the potentiometer 49 being represented by C1 (μF), the tribo-electric charge of the toner is calculated by the following equation: the tribo-electric charge (pC/g) of the toner=C1×V1/(W1−W2).

Density variations and color differences which would result from an error in T/D ratio will be described hereupon.

The aforementioned parameters in this embodiment are Y=350 (g), Q=30 (pC/mg) and A=3 (pC/mg), and a 10% variation in density substantially corresponds to a 10% change in the absolute value of the tribo-electric charge, whereas a density variation that satisfies the condition of ΔE=3 when the density reading on a reflective density meter (X-Rite) is 0.5 is ±10%. The reason for the choice of the density 0.5 is that a density variation in halftone is more conspicuous to the human eye when the apparent color is changed by a variation in density.

Here, ΔE represents the color difference, and when this ΔE is 3 or above, any variation in color flavor is conspicuous to human eye. Therefore, in order to realize an image forming apparatus providing images of high quality with little variation in color flavor, it is desirable to keep the color difference ΔE at 3 or below. Thus, it is preferable to keep density variations within ±10%, namely variations of the absolute value of the tribo-electric charge within ±10%. Then, it is necessary that the relationship of $R=[A\times\{(X/Y)\times 100\}]/Q\leqq 0.2$ be satisfied, and it is then preferable for the volume X (g) of the developer remaining in the clearance section G to satisfy the condition of $X\leqq Y\times Q/500\ A$.

Under the condition of this embodiment, X(g) is equal to 7.0 (g) or less.

Then, in view of the foregoing, the image forming apparatus of this embodiment is so configured that at least the quantity of the toner in the clearance section G between the rotary replenishment screw 55 and the conveyance path 55*a* for light magenta and light cyan is kept at 7.0 g or less.

Figure 5:
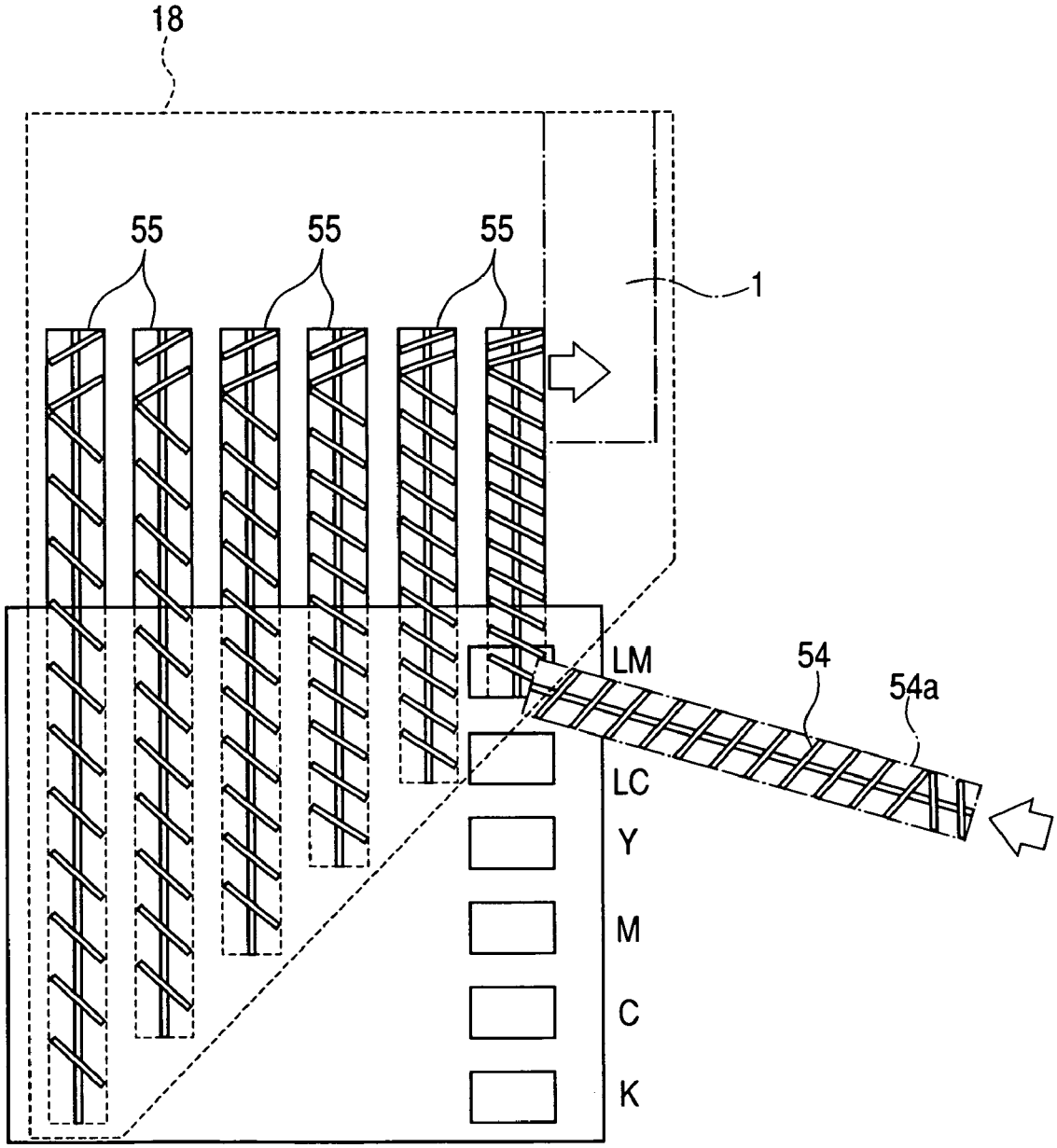
FIG. 5 is an expansion plan showing the schematic configuration of the handover section between a hopper replenishment screw and the rotary replenishment screw, cut along 5-5 in FIG. 1.
Figure 6:
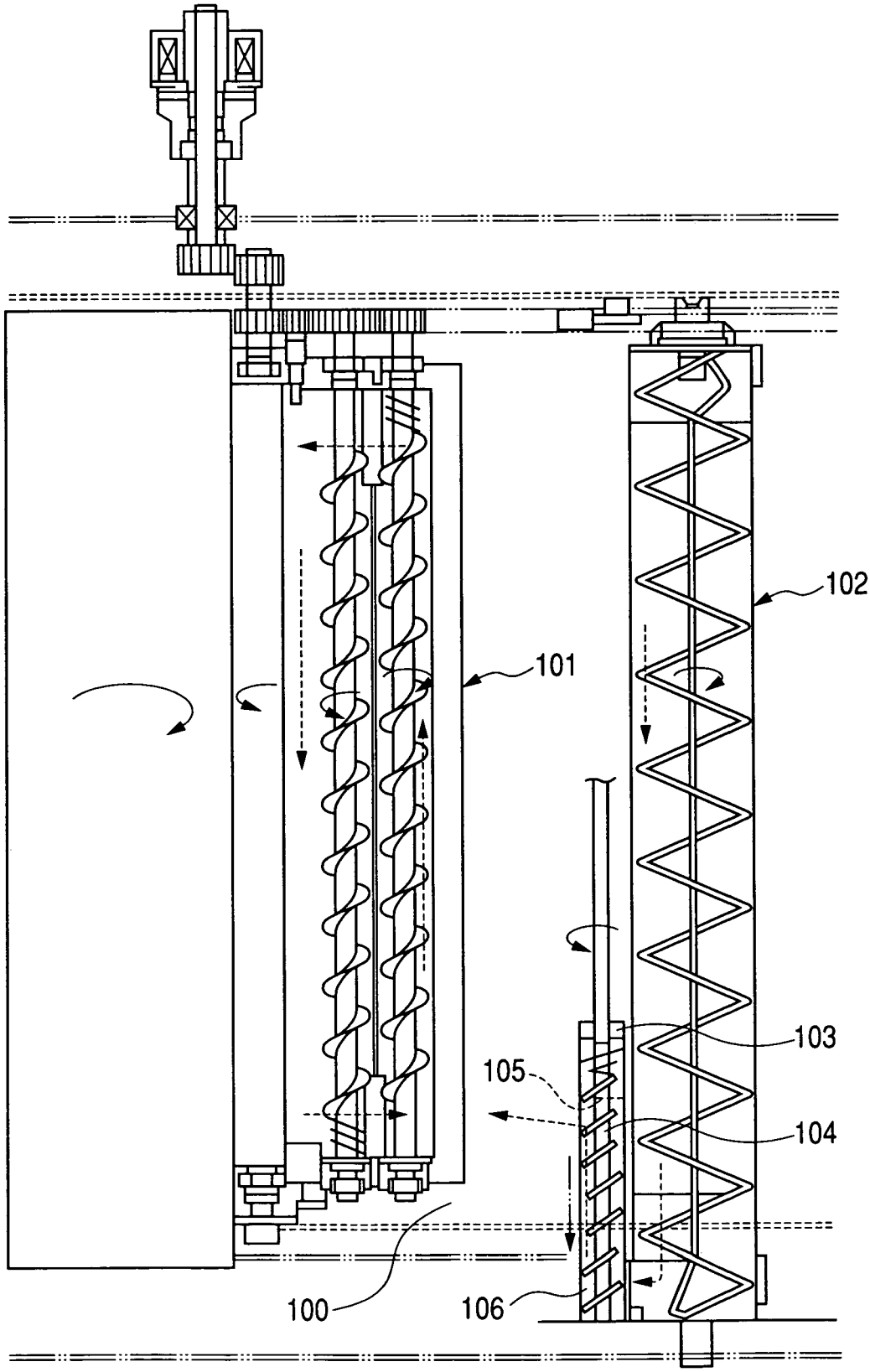
FIG. 6 illustrates the method of developer replenishment in a conventional rotary developing unit.

Of course, it is desirable for the quantity of the toner in the clearance section G between the rotary replenishment screw 55 and the conveyance path 55*a* for every color to be 7.0 g or less. However, in order to keep the cost lower, where developing devices of the same shape are to be used for all the colors, the handover section between the hopper replenishment screw 54 and the rotary replenishment screw 55 is shifted in position as shown in FIG. 5 to avoid mixing of different colors, and accordingly each pair of the hopper replenishment screw 54 and the rotary replenishment screw 55 is differentiated in length from others. For this reason, it is difficult to keep the quantity of the toner in the clearance section G between every pair of the rotary replenishment screw 55 and the conveyance path 55*a* at 7.0 g or below.

Therefore in this embodiment, the quantity of the toner in the clearance section G is set to 5.0 g for light magenta and 6.8 g for light cyan.

The configuration described above makes it possible in this embodiment of the invention to provide an image forming apparatus free from degrading of the photographed image, such as fogging, even if the rotation of the rotatable member, namely the developing rotary 18, around the rotation axis 18*a* invites unintended replenishment of the toner.

Although the present invention has been described with reference to a specific embodiment thereof, the configurations of the developer and the image forming apparatus are not limited to those used in this embodiment, but obviously the invention can be applied to various other developers and image forming apparatuses. In more specific terms, the sequence of the development of the toners of different colors, the number of developing devices, and the colors of toners are not limited to those used in this embodiment.

This application claims priority from Japanese Patent Application No. 2004-304969 filed Oct. 19, 2004, which is hereby incorporated by reference herein.

What is claimed is:

1. An image forming apparatus comprising:

a developing device which develops an electrostatic image on an image bearing member with a developer including toner and carrier;

a movable member which supports said developing device and is movable between a developing position at which said developing device is opposed to said image bearing member and a non-developing position at which said developing device is not opposed said image bearing member;

a replenishment device which feeds a developer for replenishment to said developing device;

a developer replenishment path which is supported by said movable member and allows the developer for replenishment to be fed from said replenishment device to said developing device; and a conveyance screw arranged within the developer replenishment path so as not to come into contact with an internal wall of the developer replenishment path, wherein X (g) representing a quantity of the developer for replenishment present in a clearance section between said developer replenishment path and said conveyance screw, Y (g) representing a quantity of the developer in said developing device, Q(μC/mg) representing an absolute value of a electric charge per unit weight of toner in said developing device, and A(μC/mg) representing an absolute value of a variation value of an electric charge per unit weight of the toner corrsponding to a 1% variation of a toner density value in the developer in said developing device, X (g), Y (g), Q(μC/mg) and A(μC/mg) satisfies a relationship of $X \leqq (Y \times Q)/(500 \times A)$.

2. An image forming apparatus according to claim 1, wherein said movable member is a rotable member, and wherein five or more developing devices are provided on said rotatable member so that said five or more developing devices are moved to the developing position in turn.

3. An image forming apparatus according to claim 1, wherein a color of the toner in said developing device is light magenta.

4. An image forming apparatus according to claim 1, wherein a color of the toner in said developing device is light cyan.

* * * * *

UNITED STATES PATENT AND TRADEMARK OFFICE

CERTIFICATE OF CORRECTION

PATENT NO. : 7,386,261 B2
APPLICATION NO. : 11/242939
DATED : June 10, 2008
INVENTOR(S) : Akihiro Noguchi et al.

It is certified that error appears in the above-identified patent and that said Letters Patent is hereby corrected as shown below:

TITLE PAGE [56] References Cited, FOREIGN PATENT DOCUMENTS

"10020584" should read --10-020584--.

COLUMN 1

Line 12, "turns" should read --turn--.
Line 38, "rotatable(hereinafter" should read --rotatable (hereinafter--.

COLUMN 2

Line 49, "seriously" should read --greatly--.
Line 51, "objected" should read --object--.
Line 59, opposed" should read --opposed to--.

COLUMN 5

Line 43, "mage" should read --image--.
Line 60, "device(automatic" should read --device (automatic--.

COLUMN 8

Line 56, "opposed" should read --opposed to--.

COLUMN 9

Line 7, "a" should read --an--.
Line 14, "satisfies" should read --satisfy--.

COLUMN 10

Line 2, "rotable" should read --rotatable--.

Signed and Sealed this

Fourth Day of November, 2008

JON W. DUDAS
*Director of the United States Patent and Trademark Office*